US006035624A

United States Patent [19]

Kaneko et al.

[11] Patent Number: 6,035,624

[45] Date of Patent: Mar. 14, 2000

[54] FIBER TRANSPORTING APPARATUS FOR A ROTOR TYPE OPEN END FINE SPINNING MACHINE

[75] Inventors: Masashi Kaneko; Keiji Onoue; Yasuyuki Kawai, all of Aichi-ken, Japan

[73] Assignee: Kabushiki Kaisha Toyoda Jidoshokki Seisakusho, Aichi-ken, Japan

[21] Appl. No.: 09/198,215

[22] Filed: Nov. 23, 1998

[30] Foreign Application Priority Data

Nov. 21, 1997 [JP] Japan ..... 9-321569

[51] Int. Cl.[7] ..... D01N 4/00

[52] U.S. Cl. ..... 57/411; 57/301; 57/408

[58] Field of Search ..... 57/404, 406, 408, 57/413, 411, 301, 304; 19/112, 114, 98

[56] References Cited

U.S. PATENT DOCUMENTS

| | | | |
|---|---|---|---|
| 3,792,575 | 2/1974 | Doudlebsky et al. | 57/301 |
| 3,892,063 | 7/1975 | Doudlebsky et al. | 57/411 |
| 4,036,002 | 7/1977 | Kobayashi | 57/411 |
| 4,201,037 | 5/1980 | Artzt et al. | 57/301 |
| 4,204,393 | 5/1980 | Miyazaki et al. | 57/304 |
| 4,429,522 | 2/1984 | Ferkl et al. | 57/301 |
| 4,459,800 | 7/1984 | Stahlecker | 57/411 |
| 4,607,485 | 8/1986 | Stahlecker | 57/411 |
| 5,809,766 | 9/1998 | Stahlecker | 57/304 |
| 5,832,710 | 11/1998 | Geerlings | 57/408 |

FOREIGN PATENT DOCUMENTS

| | | |
|---|---|---|
| 57-199821 | 12/1982 | Japan . |
| 59-1732 | 1/1984 | Japan . |
| 5-44119 | 2/1993 | Japan . |
| 5-86512 | 4/1993 | Japan . |

*Primary Examiner*—William Stryjewski
*Attorney, Agent, or Firm*—Morgan & Finnegan, L.L.P.

[57] ABSTRACT

A fiber transporting apparatus for a rotor type open end fine spinning machine is provided that may reduce an amount of effective fiber discharged from a burling opening portion without degrading yarn quality of the spun yarn. Fiber opened by a combing roller (11) is fed into a rotor through a fiber transporting channel (13) leading from a circumferential surface of the combing roller (11) to a predetermined position of the rotor (6) in accordance with a negative pressure degree within the rotor (6). After debris is removed from the opened fiber by a burling opening portion (12), the opened fiber is moved together with an air flow directed from a downstream side of the burling opening portion (12) in a rotational direction of the combing roller (11) toward an inlet (13*a*) of the fiber transporting channel (13). A portion of the air flow directed toward the inlet (13*a*) of the fiber transporting channel (13) is led from a suction passage (17) to a negative pressure source (5) along the way, and the flow rate of air introduced from an outlet (13*b*) of the fiber transporting channel (13) to a rotor (6) is reduced. Accordingly, even if the flow rate of the air directed from the burling opening portion (12) to the fiber transporting channel (13) is increased, the flow rate of the air introduced into the rotor (6) is kept at a suitable level.

15 Claims, 7 Drawing Sheets

FIBER TRANSPORTING APPARATUS FOR A ROTOR TYPE OPEN END FINE SPINNING MACHINE

BACKGROUND OF THE INVENTION

1. Field of the Invention

The present invention relates to a fiber transporting apparatus for a rotor type open end fine spinning machine, provided with a fiber opening device for opening a sliver with a combing roller.

2. Description of the Related Art

In general, in a rotor type open end fine spinning machine, a feed sliver is opened with a combing roller so that impurities are removed from the sliver. The fibers opened such that they are separated are transported into a rotor by a flow of gas generated within a fiber transporting path (fiber transporting channel) on the basis of a negative pressure within the rotor, which rotates at a high speed. The fibers which have been transported into the rotor collect at a fiber collecting portion (fiber collecting groove) which is the maximum inner diameter portion of the rotor, drawn out from a guide hole (yarn drawing passage) formed at a center of a navel by the action of a drawing roller. At the same time, the fibers are formed into a yarn while being spun by the rotation of the rotor to be wound up as a package around a bobbin. Also, in the open end fine spinning machine, a burling opening portion (burling chamber) is provided for removing impurities (debris) such as leaf matter or seed matter separated from the opened fibers by the action of the combing roller.

The opened fibers are moved along a circumferential surface of the combing roller by the gas flow generated by the negative pressure within the rotor and are introduced through a space, communicated with the fiber transporting path, to the fiber transporting path after passing through the burling opening portion. In this case, if an air flow amount to the fiber transporting path from the burling opening portion is small, a portion of the opened fibers is discharged from the burling opening portion. As a result, there is a problem in that an effective amount of fibers to be fed into the rotor is decreased. Also, if the above-described air amount is increased, the air flow to be blown into the rotor from the fiber transporting path becomes so strong that the fibers collide strongly with the rotor wall and are bent. As a result, there is a problem in that the quality of manufactured yarn (yarn quality) is degraded. The latter phenomenon becomes great when manufacturing a thin yarn, which has a small fiber transporting amount.

Also, since all of the impurities contained in the feed sliver are not removed by the burling opening portion and are fed into the rotor without separating fine matter or the like therefrom, matter or the like is accumulated on the fiber collecting portion. Accordingly, in the rotor type open end fine spinning machine, it is necessary to clean the fiber collecting portion periodically at short intervals.

In order to solve the latter problem, i.e., the problem having to clean the fiber collecting portion at short intervals, as shown in FIG. 7, Japanese Patent Application Laid-Open No. 57-199821 discloses an apparatus in which a suction passage 53 is connected to a midportion of a fiber transporting path 52 for feeding opened fibers into a rotor 51, and a portion of an air flow flowing within the fiber transporting path 52 is not fed into the rotor 51 but discharged from the fiber transporting path 52. In this apparatus, the fine matter, etc. fed into the fiber transporting path 52 that has not been removed at the burling opening portion is separated from the fibers by the air flow discharged from the suction passage 53. As a result, the cleaning interval may be considerably prolonged.

Also, it is possible to reduce the amount of air to be blown into the rotor without reducing the amount of air to the fiber transporting path 52 from the burling opening portion. As a result, it is possible to reduce the amount of effective fibers discharged from the burling opening portion.

However, in the apparatus disclosed in Japanese Patent Application Laid-Open No. 57-199821, turbulence occurs in the fiber transporting flow of the portion of the air flow flowing through the fiber transporting path 52 to be introduced into the suction passage 53. Then, since a distance between an outlet of the fiber transporting path 52 and a joint position of the suction passage 53 with the fiber transporting path 52 is short, the turbulence of the fiber transporting flow is not rectified, so that the fibers are bent and the yarn quality of the spun yarn is degraded.

SUMMARY OF THE INVENTION

Accordingly, in order to overcome the above-noted defects, an object of the present invention is to provide a fiber transporting apparatus for a rotor type open end fine spinning machine that may reduce an amount of effective fiber discharged from a burling opening portion without degrading a yarn quality of spun yarn.

In order to attain this and other objects, there is provided a rotor type open end fine spinning machine provided with a fiber transporting passage leading from a circumferential surface of a combing roller to a predetermined position within a rotor for introducing fiber opened by an opening device having the combing roller, and a burling opening portion provided on a downstream side of the fiber feed portion in a rotational direction of the combing roller between a fiber feed portion for feeding sliver to the combing roller and an inlet corresponding to the circumferential surface of the combing roller of the fiber transporting passage, characterized in that: a second end portion of a suction passage, a first end portion thereof being communicated with a negative pressure source, is opened to a wall surface surrounding a periphery of the combing roller between the inlet of the fiber transporting passage and the burling opening portion.

With such a structure, the fiber opened by the opening device provided with the combing roller is fed into the rotor via the fiber transporting passage that extends from the circumferential surface of the combing roller to a predetermined position within the rotor, on the basis of the negative pressure within the rotor. The opened fiber fed into the rotor slides along the wall surface of the rotor and collects at the collecting portion. The end of the fiber bundle collected at the fiber collecting portion is made continuous with the yarn drawn by a drawing roller and is stripped from the fiber collecting portion and drawn as a yarn while being twisted. After debris has been removed from the opened fiber at the hurling opening portion provided midway in the wall surface covering the circumferential surface of the combing roller, the opened fiber is moved together with the air flow directed toward the inlet of the fiber transporting passage from the downstream side of the burling opening portion in the rotational direction of the combing roller. A portion of the air flow directed toward the inlet of the fiber transporting passage is introduced from the suction passage to the negative pressure source along the way. Accordingly, the flow rate of the air to be introduced from the outlet of the fiber transporting passage to the interior of the rotor is reduced. Accordingly, even if the flow rate of the air directed from the burling opening portion to the inlet of the fiber transporting passage is increased, the air flow rate of the air to be introduced into the rotor is kept at a suitable flow rate.

According to another aspect of the invention, the opening of the suction passage is formed in the vicinity of the burling opening portion. Since the opening of the suction passage is formed in the vicinity of the burling opening portion, the suction action of the suction passage hardly affects the air flow within the fiber transporting passage.

According to still another aspect of the invention, a width of the opening of the suction passage is formed to be substantially the same as that of the combing roller. Since the width of the opening of the suction passage is formed to be substantially the same as that of the combing roller, unlike the case where a plurality of openings having small opening areas are formed, the suction action to the opened fiber moving along the circumferential surface of the combing roller is prevented from being increased locally. As a result, it is possible to prevent the discharge of the effective fiber from the suction passage.

According to another aspect of the present invention, the open end fine spinning machine is a forced exhaust type, and the negative pressure source is commonly used as the negative pressure source for the rotor. Namely, the rotor is disposed within the chamber connected to the negative pressure source. The air within the rotor is forcibly exhausted in accordance with the negative pressure of the negative pressure source. Then, the negative pressure source of the rotor is commonly used as the negative pressure source of the suction passage.

According to another aspect of the invention, a flow rate adjusting means is provided midway in the suction passage. With the flow rate adjusting means provided midway in the suction passage, it is possible to adjust the flow rate of the suction passage to a suitable level that corresponds to the spinning conditions.

According to another aspect of the invention, the negative pressure source is provided independently of the negative pressure source of the rotor and the degree of the negative pressure applied to the suction passage is adjustable. Namely, the suction passage is connected to the negative pressure source provided independently of the negative pressure source of the rotor, and the vacuum pressure thereof is adjusted independently of the negative pressure applied to the rotor on the basis of the negative pressure of the negative pressure source.

DESCRIPTION OF THE PREFERRED EMBODIMENTS

Figure 1:
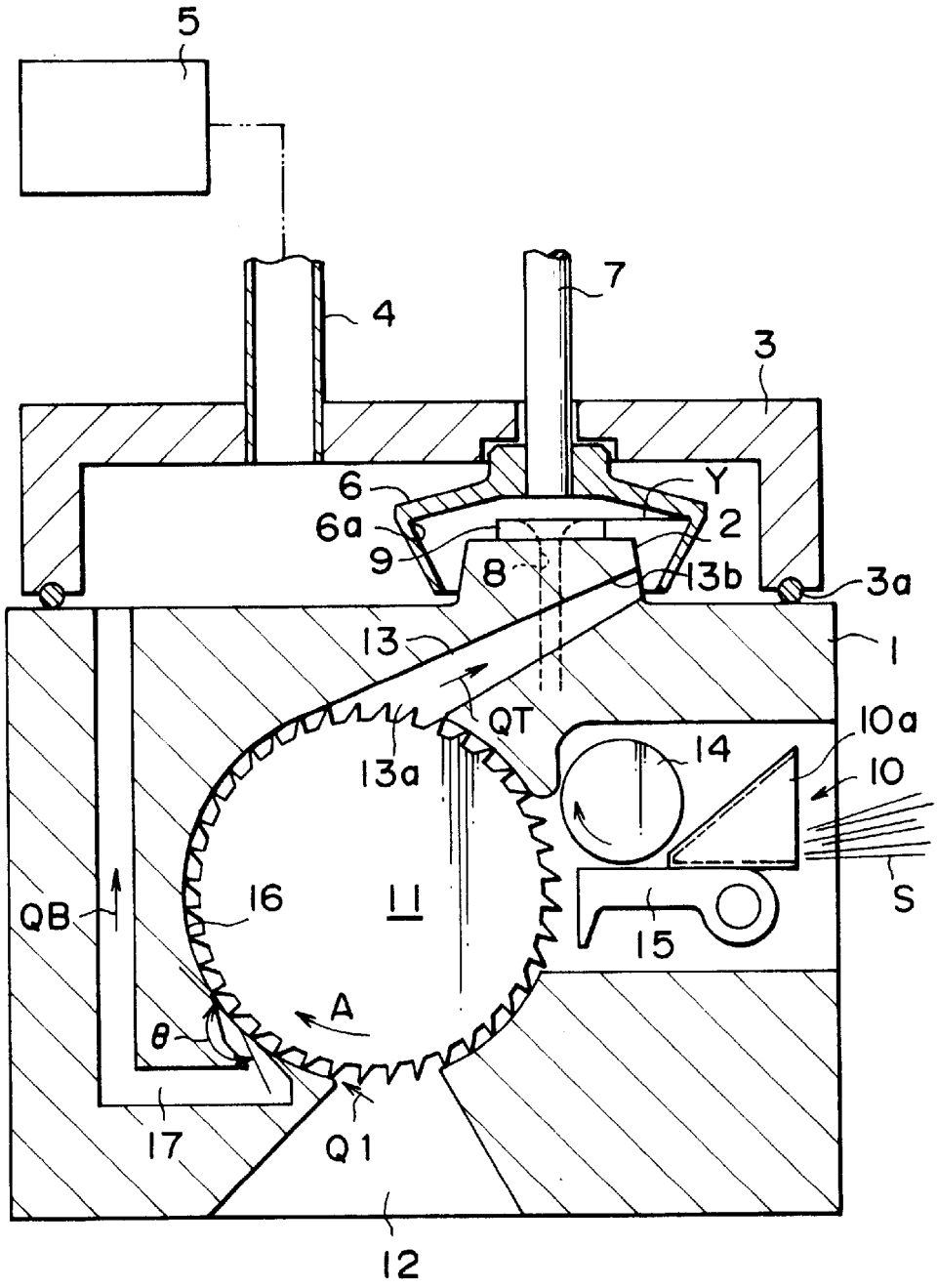
FIG. 1 is a schematic cross-sectional view showing an open end fine spinning machine according to a first embodiment of the present invention.

In the following description, same reference numerals are used to indicate same and like components throughout the drawings. Further, in the following description, it is to be understood that the terms "right", "left", "upper" and "lower" are used for the sake of easy explanation and are not to be construed as limiting.

Embodiment 1

Figure 2:
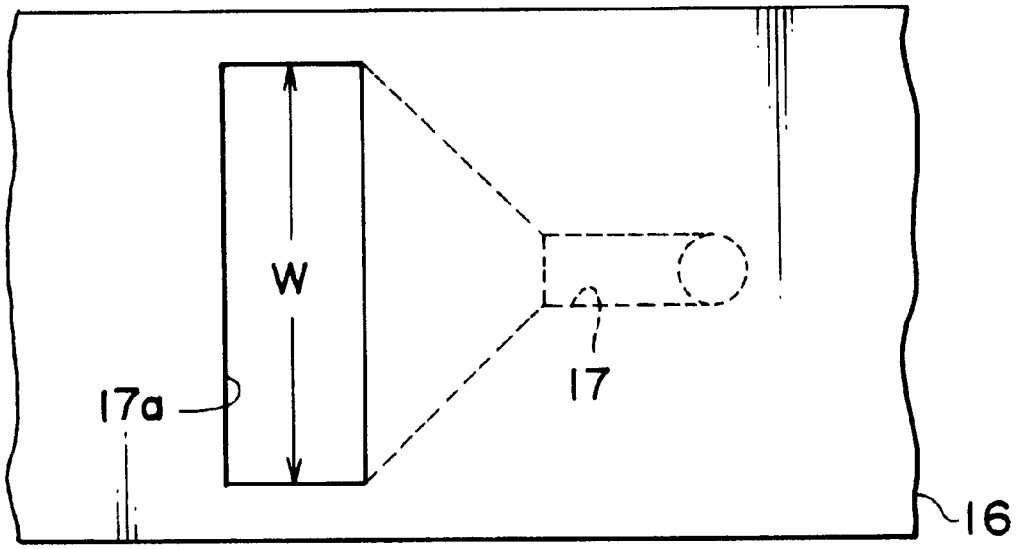
FIG. 2 is a schematic view showing a shape of an opening portion.

A first embodiment in which the present invention is embodied in the form of a forced exhaust type open end fine spinning machine will now be described with reference to FIGS. 1 and 2. As shown in FIG. 1, a boss portion 2 is formed on an outer surface of a housing 1 of the open end fine spinning machine. A casing 3 is arranged at a position corresponding to the outer surface of the housing 1 on which the boss portion 2 is formed such that the casing 3 is kept in contact with the housing 1 through O-rings 3*a*. The casing 3 is connected to a negative pressure source 5 through a pipe 4. Within the casing 3, i.e., a chamber defined by the casing 3 and the housing 1, a rotor 6 is disposed such that it is supported at and rotatable together with a rotary shaft 7 which is provided through the casing 3. The rotary shaft 7 is rotated by a drive means (not shown).

The rotor 6 is arranged such that the center thereof faces the center of the boss portion 2 and the boss portion 2 is projected into the rotor 6. A fiber collecting groove 6*a* is formed as a fiber collecting portion at a maximum inner diameter portion of an inner wall of the rotor 6. A navel 9 at which one end of a yarn drawing passage 8 is opened is formed in the central portion of the boss portion 2. The end of the yarn drawing passage 8 is communicated with a yarn pipe (not shown) disposed so as to intersect a centerline of the navel 9. The end portion of the yarn pipe at the navel 9 is a starting point for twisting the yarn.

In the housing 1, a fiber feed portion 10, a combing roller 11 constituting an opening device, a burling opening portion 12 and a fiber transporting channel 13 used as a fiber transporting passage are provided. The combing roller 11 is provided so as to ratatable by a drive means (not shown) in the direction of the arrow A in FIG. 1. The fiber feed portion 10 is provided with a feed port 10*a*, a feed roller 14 and a presser 15. The burling opening portion 12 is provided on the downstream side in the rotational direction of the combing roller 11 relative to the fiber feed portion 10. A fiber transporting channel 13 is formed at the opposite side of the burling opening portion 12 relative to the center of the combing roller 11 such that an inlet 13*a* opens to a position corresponding to the circumferential surface of the combing roller 11, and an outlet 13*b* opens to the circumferential surface of the boss portion 2. The fiber transporting channel 13 is formed such that the cross-sectional area thereof gradually decreases from the inlet 13*a* to the outlet 13*b*. Then, an air flow toward the fiber transporting channel 13 is generated in accordance with the negative pressure within the rotor 6.

A suction passage 17 having a first end portion opened to a position corresponding to a space surrounded by the casing 3 and a second end portion opened to a wall surface 16 surrounding the periphery of the combing roller 11 between the inlet of the fiber transporting channel 13 and the burling opening portion 12, are formed in the housing 1. Namely, the suction passage 17 is communicated with the negative pressure source 5 through the casing 3 and the pipe 4. The negative pressure source 5 for the rotor 6 is also used as the negative pressure source for the suction passage 17.

An opening portion 17*a* of the suction passage 17 formed in the wall surface 16 is formed in the vicinity of the burling opening portion 12. As shown in FIG. 2, the opening portion 17*a* is formed as a rectangular shape having substantially the same width W as a width of the combing roller 11. The suction passage 17 is formed so as to gradually expand from the vicinity of the wall surface 16 toward the opening portion 17*a*. Also, the suction passage 17 is formed such that an angle θ, formed between a direction in which the inlet portion extends and a direction in which the fiber runs (i.e., in a direction tangential to the circumferential surface of the combing roller 11) at a position where the opening portion 17*a* is formed, is greater than 90°. It is preferable that the angle θ is in the range of 150 to 180°.

The operation of the apparatus thus constructed will now be described. In the spinning-out operation, the rotary shaft 7 and the rotor 6 are rotatively driven by the action of the drive means. Also, the interior of the casing 3 and the rotor 6 are made to have a negative pressure through the pipe 4 by the action of the negative pressure source 5 so that the air flow toward the interior of the rotor 6 is generated through the fiber transporting channel 13 on the basis of the negative pressure within the rotor 6. On the other hand, the sliver S held between the feed roller 14 and the presser 15, is fed from the feed port 10 and opened by the action of the combing roller 11, and the opened fiber is moved, substantially together with the combing roller 11, toward the fiber transporting channel 13 along the circumferential surface of the combing roller 11. When the opened fiber passes through the position corresponding to the burling opening portion 12, debris such as leaf or seed matter is removed from the opened fiber and discharged to the burling opening portion 12. Then, the opened fiber from which debris has been removed is moved from the burling opening portion 12 along the wall surface 16 on the downstream side of the rotational direction of the combing roller 11.

Then, the opened fiber which has been moved to the inlet 13*a* of the fiber transporting channel 13 is stripped away from the combing roller 11 by the air flow toward the fiber transporting channel 13 and transported into the rotor 6 together with the air flow. The opened fiber fed into the rotor 6 from the fiber transporting channel 13 adheres to the inner wall surface of the rotor 6 and simultaneously slides along the inner wall surface to collect at the fiber collecting groove 6*a*. The fiber bundle collected at the fiber collecting groove 6*a* is connected with the yarn Y to be drawn through the yarn drawing passage 8 by a drawing roller (not shown). Consequently, the collected fiber bundle is stripped away from the fiber collecting groove 6*a* in accordance with the drawing of the yarn Y and is drawn as the yarn Y.

A portion of the air flow directed from the burling opening portion 12 to the fiber transporting channel 13 is introduced from the suction passage 17 to the casing 3 along the way. Assuming that QT is the flow rate of the air flow introduced into the rotor 6 from the outlet 13*b* of the fiber transporting channel 13 and QB is the flow rate of the air flow introduced into the casing 3 through the suction passage 17, a flow rate Q1 of the air flow from the burling opening portion 12 toward the fiber transporting channel 13 becomes the sum of the flow rates QT and QB. Accordingly, by setting the flow rate QB of the air flow of the suction passage 17 at a suitable level, it is possible to set the flow rate QT of the air flow introduced into the rotor 6 and the flow rate Q1 of the air flow from the burling opening portion 12 at their desired levels. In this embodiment, when the opened fiber is fed into the rotor 6, the flow rate QT is set at a suitable flow rate such that the opened fiber does not collide with the inner wall surface of the rotor 6 and become bent. Also, when the opened fiber is passed through the burling opening portion 12, the flow rate Q1 is set at a flow rate such that the fiber which is effective to produce yarn can be prevented from being discharged to the burling opening portion 12. Accordingly, it is possible to reduce the amount of the effective fiber escaping from the burling opening portion 12. Also, the yarn quality of the spun yarn is prevented from being degraded.

Since the opening portion 17*a* is formed in the vicinity of the burling opening portion 12, the suction action of the suction passage 17 hardly affects the air flow within the fiber transporting channel 13. Consequently, the air flow within the fiber transporting channel 13 flows without any turbulence. Accordingly, even if the opened fiber is subjected to turbulence by the suction action of the opening portion 17*a*, the turbulence may be corrected while the opened fiber runs through the fiber transporting channel 13.

Also, since the width of the opening portion 17*a* is large and substantially the same as the width of the combing roller 11, it is possible to maintain the required flow rate of the air flowing through the suction passage 17 when the flow rate is low in the vicinity of the opening portion 17*a*. Accordingly, introduction of the opened fiber, moving together with the air flow toward the fiber transporting channel 13 along the wall surface 16, to the suction passage 17 is suppressed. Also, since the angle θ of the suction passage 17 on the inlet side is formed to be greater than 90°, the flow direction of the air flow introduced from the opening portion 12 to the suction passage 17 does not include any component of the direction of the flow directed to the fiber transporting channel 13. Accordingly, it is difficult for the opened fiber to be carried on the air flow directed to the suction passage 17. Then, in this embodiment, since the angle θ is set in the range of 150 to 180°, it is more difficult for the opened fiber to be carried on the air flow directed to the suction passage 17.

The present embodiment exhibits the following advantages.

(A) The second end portion of the suction passage 17 is opened to the wall surface 16 surrounding the outer periphery of the combing roller 11 between the inlet 13*a* of the fiber transporting channel 13 and the burling opening portion 12. The first end portion of this suction passage 17 is communicated with the negative pressure source. Accordingly, by setting the air flow rate of the suction passage 17 at a suitable level, it is possible to suppress the discharge of the effective fiber from the burling opening portion 12 without degrading the quality of the spun yarn.

(B) Since the opening portion 17*a* is formed in the vicinity of the burling opening portion 12, the suction action of the suction passage 17 hardly affects the air flow within the fiber transporting channel 13. Accordingly, even if the turbulence is generated in the opened fiber at the position corresponding to the opening portion 17*a*, the turbulence is corrected while the opened fiber runs through the fiber transporting channel 13, and the quality of the spun yarn is not degraded.

(C) Since the width of the opening portion 17*a* is formed to be substantially the same as that of the combing roller 11, it is possible to maintain the required flow rate of the air flowing through the suction passage 17 when the flow rate in the vicinity of the opening portion 17*a* is low. Accordingly, the introduction of the opened fiber to the suction passage 17 may be suppressed.

(D) Since the single opening portion 17*a* having a large opening area is provided, it is easy to form the opening portion compared to forming a plurality of opening portions each having a small opening area. Also, unlike the case where the small opening portions are formed, the suction action applied to the opened fiber moving along the circumferential surface of the combing roller is prevented from being locally increased and it is possible to prevent the effective fiber from being discharged from the suction passage.

(E) Since the negative pressure source 5 for the rotor 6 is also used as the negative pressure source for the suction passage 17, it is not necessary to provide a new negative pressure source for the suction passage 17, thereby simplifying the structure.

(F) Since the suction passage 17 is formed so that its angle θ on the inlet side is greater than 90°, it is difficult for the opened fiber to be carried on the air flow directed to the suction passage 17 and the discharge of the effective fiber to the suction passage 17 may be suppressed. When the angle θ is set in the range of 150° to 180°, there is almost no discharge of the effective fiber.

(G) Since the first end portion of the suction passage 17 is formed within the housing 1 so as to be opened to the position corresponding to the interior of the casing 3, it is easy to maintain the space formed by the suction passage 17, and it is unnecessary to provide an additional pipe passage to communicate the suction passage 17 and the negative pressure source 5.

Embodiment 2

Figure 3:
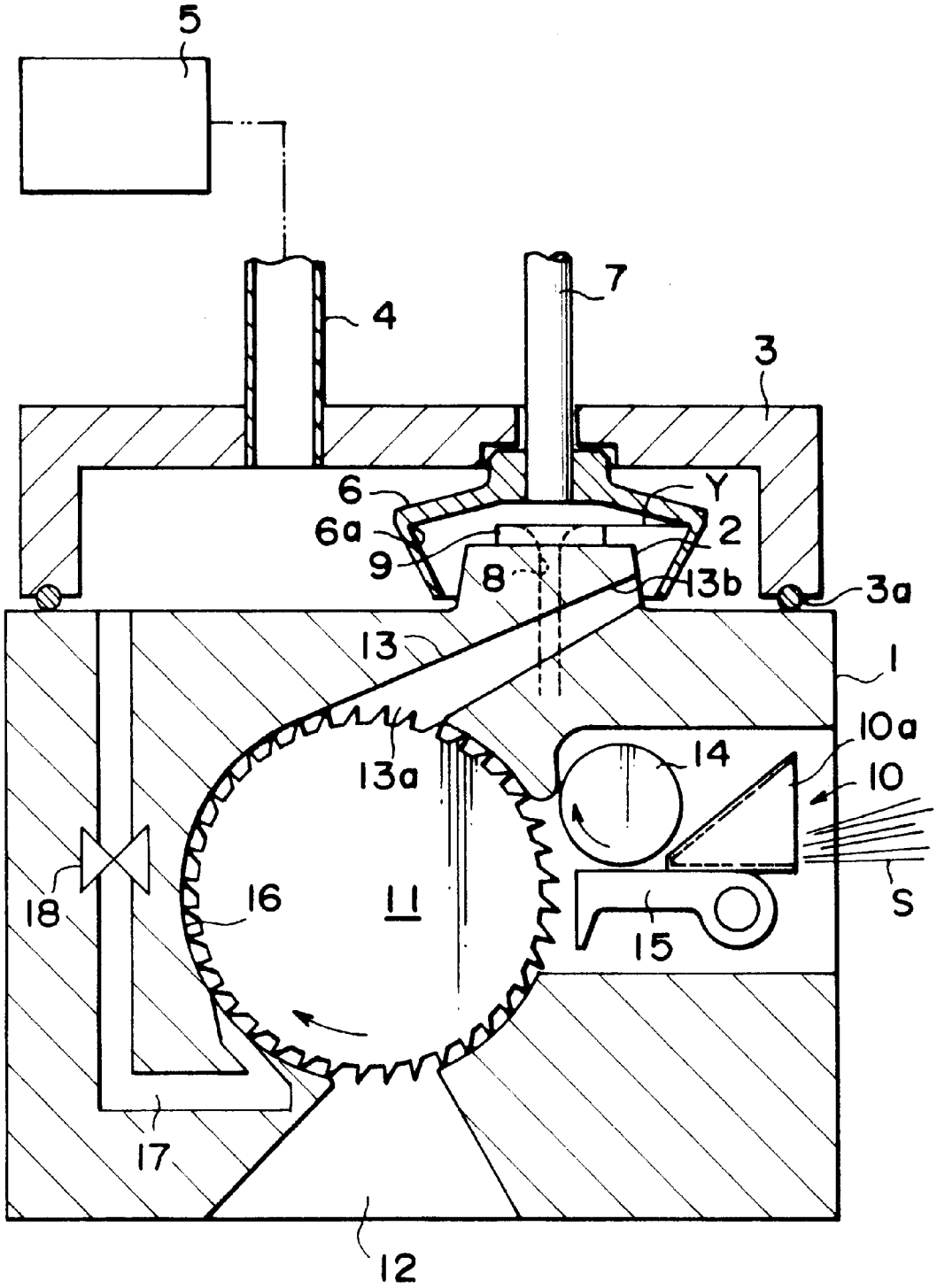
FIG. 3 is a schematic cross-sectional view showing an open end fine spinning machine according to a second embodiment of the present invention.

A second embodiment will now be described with reference to FIG. 3. The second embodiment is different from the first embodiment only in that the flow rate of the air flow flowing through the suction passage 17 is made variable, and all other structures are the same. Accordingly, the same reference numerals are used to indicate same components or members and their detailed explanation will be omitted.

A flow rate adjustable valve 18 is provided as a flow rate adjusting means midway in the suction passage 17. The flow rate adjustable valve 18 may be either a manually operated valve or an electromagnetically operated valve. In a rotor type open end fine spinning machine, a rotor is used having a suitable diameter for the spinning conditions, mainly, the yarn count. Also, a suitable level for the flow rate QT of the air flow introduced into the rotor 6 is different. When a thin yarn is manufactured, it is necessary to reduce the flow rate QT to be less than the case where a thick yarn is manufactured. In the above-described embodiment in which the flow rate adjusting means is not provided in the suction passage 17, it is necessary to reduce the degree of the negative pressure of the negative pressure source 5 in order to reduce the flow rate QT. However, if the negative pressure of the negative pressure source 5 is changed, the flow rate QB of the air flow through the suction passage 17 is changed correspondingly. If the negative pressure becomes small, the flow rate QB is also reduced so that the effect of suppressing the effective fiber from being discharged from the burling opening portion 12 is reduced. Accordingly, since a plurality of housings 1 provided with the suction passages 17 corresponding to the yarn count of the spun yarn must be prepared and used according to the spinning conditions, the work of exchanging them is troublesome.

In the second embodiment, even if the level of the negative pressure of the negative pressure source 5 is kept constant, if the opening degree of the flow rate adjustable valve 18 is increased, the flow rate QB of the air flow of the suction passage 17 is increased, and the flow rate QT of the air flow introduced into the rotor 6 is reduced. Also, if the opening degree of the flow rate adjustable valve 18 is reduced, the flow rate QB of the air flow through the suction passage 17 is reduced and the flow rate of the air flow introduced into the rotor 6 is increased. Accordingly, by adjusting the opening degree of the flow rate adjustable valve 18 to an opening degree corresponding to the yarn count of the spun yarn, the flow rate Q1 of the air flow from the burling opening portion 12 is kept constant and the flow rate QT of the air flow introduced into the rotor 6 may be adjusted to a suitable level. As a result, it is unnecessary to change the housing 1 when the spinning conditions are changed, and the work of exchanging the housings is dispensed with.

Namely, in the second embodiment, in addition to the advantages (A) to (G) of the first embodiment, there is an advantage that it is possible to dispense with the work of exchanging the housings 1 according to a change in the spinning conditions. In addition to the yarn count change, changes in the spinning conditions requiring the flow rate QT to be changed include, for example, a change in material of the sliver S.

Also, in the case where the electromagnetically operated valve is used as the flow rate adjustable valve 18, it is possible to automatically adjust the opening degree of each flow rate adjustable valve of a plurality of spinning units to a predetermined opening degree corresponding to the spinning conditions in accordance with a command signal from a controller. Accordingly, the operator does not have to perform the work of adjusting the opening degree of the flow rate adjustable valve 18 of each spinning unit.

Embodiment 3

Figure 4:
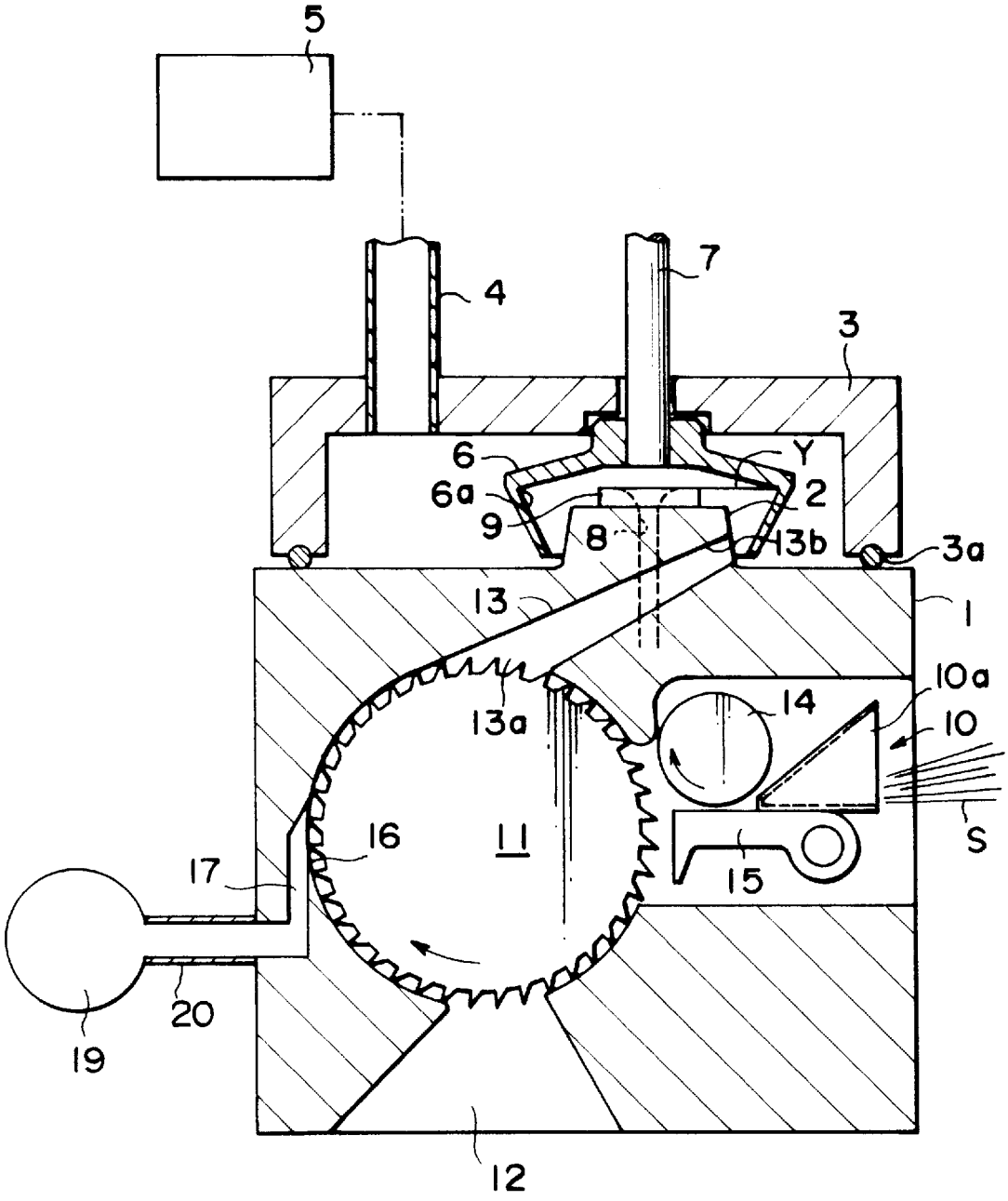
FIG. 4 is a schematic cross-sectional view showing an open end fine spinning machine according to a third embodiment of the present invention.

A third embodiment will now be described with reference to FIG. 4. The second embodiment differs from the first and second embodiments only in that the negative pressure source of the suction passage 17 is provided independently of the negative pressure source 5 of the rotor 6, and the degree of negative pressure applied to the suction passage 17 is adjustable. Accordingly, the same reference numerals are used to indicate same components or members and their detailed explanation is omitted.

The first end portion of the suction passage 17 is opened to the negative pressure source 19 independent of the negative pressure source 5 connected to the suction passage 17 through a pipe 20. The negative pressure source 19 is structured so that the negative pressure thereof is variable.

In the first and second embodiments, the degree of negative pressure of the negative pressure source 5 largely and directly affects the negative pressure within the rotor 6 and the negative pressure applied to the suction passage 17. Then, it is impossible to freely change the flow rate QT of the air flow introduced into the rotor 6 independent of the flow rate QB of the air flow introduced into the suction passage 17. In the second embodiment, also, it is impossible to freely change the flow rate QT of the air flow independent of the flow rate QB of the air flow. However, in the third embodiment, since the negative pressure sources 5 and 19 are provided for the rotor 6 and the suction passage 17 independent of each other, it is possible to readily adjust the flow rates QT and QB to the desired levels. Accordingly, without exchanging the housings 1, it is possible to perform the spinning operation at the more preferable flow rates QT and QB, according to not only changes of the yarn count of the spun yarn but also changes in other spinning conditions.

Also, the third embodiment provides the advantages (A), (C), (D) and (F) of the first embodiment.

Moreover, the mode of the present invention is not limited to the above-described specific embodiments and, for example, may be embodied as follows.

Figure 5:
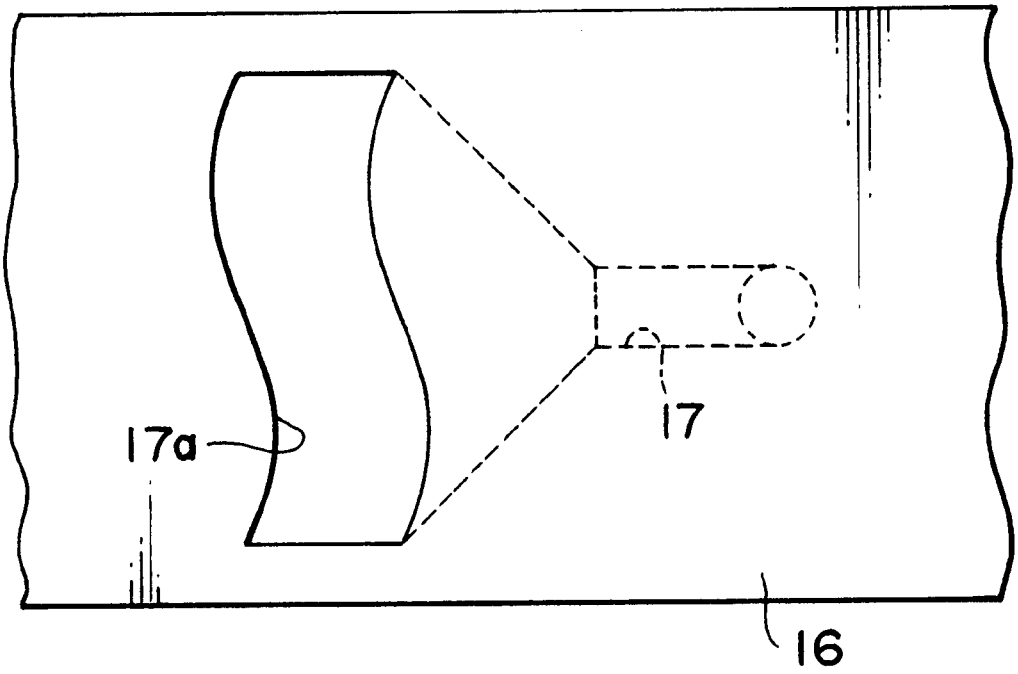
FIG. 5 is a schematic view showing another shape of an opening portion.

(1) In the case where the width of the opening portion 17*a* is formed to be substantially the same as that of the combing roller 11, the shape thereof is not limited to rectangular but, for example, may be formed as a wavy shape, as shown in FIG. 5, or an oblong shape.

Figure 6A:
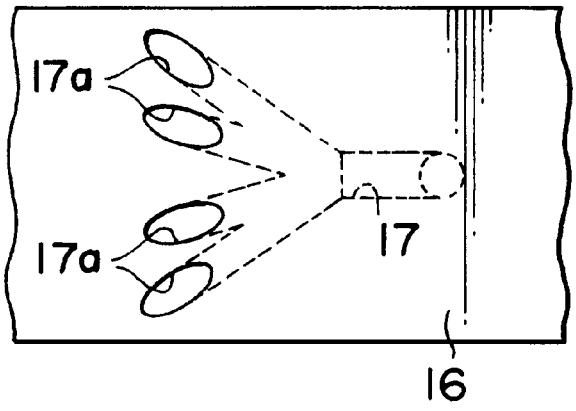
FIGS. 6(*a*) and 6(*b*) are schematic views showing shapes of other opening portions.
Figure 6B:
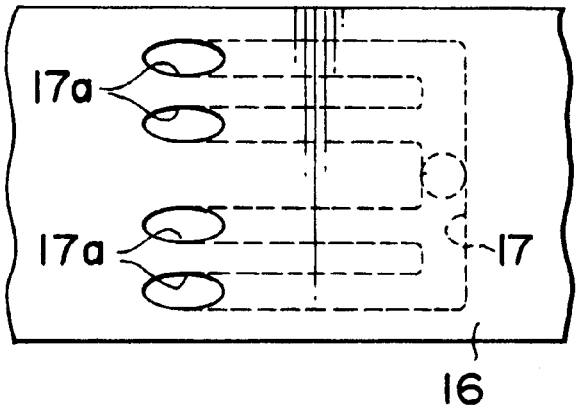
Figure 7:
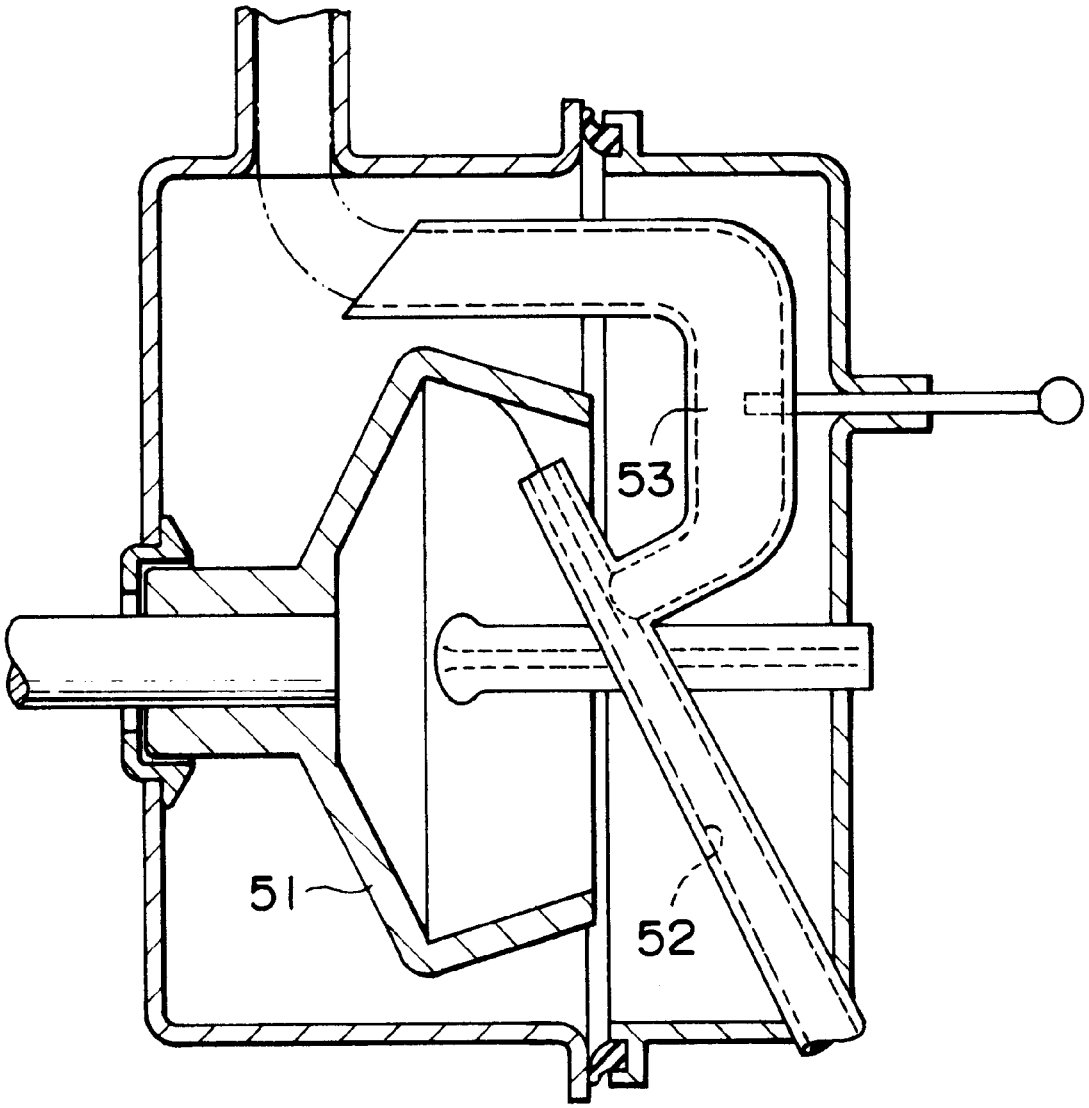
FIG. 7 is a cross-sectional view showing an essential portion of a conventional apparatus.

(2) The opening portion 17*a* does not always have to be formed with substantially the same width as that of the combing roller 11. It is also possible to provide the opening portion 17*a* with a width smaller than the width of the combing roller 11. Also, the number of the opening portions 17*a* is not limited to one. As shown in FIGS. 6(*a*) and 6(*b*), it is possible to provide a plurality of opening portions 17*a* having a width smaller than the width of the combing roller 11. Also, it is possible to provide a plurality of opening portions 17*a* that have substantially the same width as that of the combing roller 11.

(3) The shape of the opening portion 17*a* may be formed in any desired shape such as circular, oblong, triangular, rectangular, polygonal and the like.

(4) The position of the opening portion 17*a* may be formed between the burling opening portion 12 and the inlet 13*a* of the fiber transporting channel 13. However, if the opening portion 17*a* is provided in the vicinity of the inlet 13*a*, the suction action from the opening portion 17*a* is likely to affect the air flow within the fiber transporting channel 13, so it is preferable to provide the opening portion 17*a* in the vicinity of the burling opening portion 12.

(5) As the structure communicating the suction passage 17 with the negative pressure source 5 of the rotor 5, a structure may be employed in which the first end portion of the suction passage 17 is not opened to the casing 3 but opened to a position other than the position facing the casing 3, and the suction passage 17 is communicated with a pipe 4 through a passage (pipe).

(6) In the third embodiment, as a method for making it possible to adjust the degree of the negative pressure applied to the suction passage 17, instead of making it possible to change the negative pressure degree of the negative pressure source 19, it is possible to provide the flow rate adjustable valve 18 as the flow rate adjusting means midway in the pipe 20.

(7) In the structure in which the negative pressure source 19 for the suction passage 17 is provided, a common negative pressure source 19 is used for a plurality of spinning units, the spinning units being divided into a plurality of groups, and it is possible to change the degrees of negative pressure applied to the suction passages 17 of each group. For example, a flow rate adjustable valve is provided for each group. In this case, it is possible to perform the flow rate adjustment of the suction passages 17 according to different spinning conditions among the respective groups, and it is possible for each group to produce yarns with different yarn counts at the same time.

(8) Instead of the fiber transporting channel 13 being formed as the passage in which the opening portion formed in the boss portion 2, which in turn is formed in the housing 1, it is formed as the outlet, and the fiber transporting channel 13 may be formed by a pipe with a proximal end thereof being disposed at a position to face the circumferential surface of the combing roller 11 and with a distal end thereof being disposed at a predetermined position within the rotor 6.

(9) As the method to keep the interior of the rotor 6 under negative pressure, instead of the forced exhaust system, a self-exhaust system may be used. Namely, the negative pressure source 5 is dispensed with, and the exhaust hole for the self-exhaust system is formed in, the rotor 6. In this case, the suction passage 17 is connected to the negative pressure source 19 for the suction passage 17. Further, in addition to the forced exhaust system, self-exhaust exhaust holes may be provided in the rotor 6.

(10) The present invention may be applied to an open end fine spinning machine (for example, Japanese Patent Application Laid-Open Nos. 5-44119 and 5-86512) provided with an inner rotor within the rotor 6 having an opening (yarn path) rotating at a different speed than the rotational speed of the rotor for drawing a fiber bundle F collected at a fiber collecting portion and leading the yarn to the yarn drawing passage 8.

Further, in the present specification, not only does the "negative pressure source for the rotor" mean the forced exhaust type negative pressure source but also includes a system in which the rotor itself serves as the negative pressure source, like a rotor in the self-exhaust system.

The technical concepts (inventions) other than those described in the appended claims, which may be understood from the respective embodiments, will now be described together with their effects and advantages.

(i) An open end fine spinning machine according to the present invention may be provided with an inner rotor within the rotor having an opening portion (yarn path) rotating at a different speed than the rotational speed of the rotor for drawing a fiber bundle collected at a fiber collecting portion and leading the yarn to the yarn drawing passage. In this case, the yarn quality of the spun yarn is further enhanced.

(ii) In the open end fine spinning machine according to the present invention, in the case where the negative pressure source is provided independently of the negative pressure source for the rotor, the negative pressure source is used for the plurality of spinning units, and the negative pressure source per se may be formed so that it has an adjustable negative pressure. In this case, the negative pressure of the negative pressure source is adjusted to a suitable level according to the spinning conditions so that the negative pressure within the suction passages in each spinning unit may be automatically set at a suitable level. Thus, it is unnecessary to adjust the negative pressure for each suction passage. Accordingly, in the case where the plurality of spinning units are connected to the single negative pressure source, the adjustment of the negative pressure according to changes in the spinning conditions may be simplified.

Various details of the present invention may be changed without departing from the spirit and scope thereof. Furthermore, the foregoing description of the embodiments according to the present invention is provided for the purpose of illustration only, and not for the purpose of limiting the invention as defined by the appended claims and their equivalents.

What is claimed is:

1. A fiber transporting apparatus for a rotor type open end fine spinning machine provided with a fiber transporting passage (13) leading from a circumferential surface of a combing roller (11), which is surrounded about its periphery by a wall surface (16) of a housing (1), to a predetermined position within a rotor (6) for introducing fiber opened by an opening device provided with the combing roller (11), and a separate burling opening portion (12) provided in the wall surface (16) on a downstream side of a separate fiber feed portion (10) opening provided in the wall surface (16) in a rotational direction of the combing roller between the fiber feed portion (10) for feeding sliver (S) to the combing roller and a separate inlet (13*a*) provided in the wall surface (16) corresponding to the circumferential surface of the combing roller of the fiber transporting passage (13), wherein:

a second end portion of a suction passage (17), whose first end portion is communicated with a vacuum source, is opened through a separate opening in the wall surface (16) between the inlet (13*a*) of the fiber transporting passage (13) and the burling opening portion (12).

2. The apparatus according to claim 1, wherein the second end portion of the suction passage is opened to the wall surface at a location adjacent to the burling opening portion (12) provided in the wall surface (16).

3. The apparatus according to claim 2, wherein a width of the second end portion of the suction passage is formed to be substantially the same as a width of the combing roller (11).

4. The apparatus according to claim 3, wherein said open end fine spinning machine is a forced exhaust type, and the vacuum source is communicated with the rotor (6).

5. The apparatus according to claim 4, wherein a flow rate adjusting means (18) is provided midway in said suction passage (17).

6. The apparatus according to claim 5, wherein an angle (θ) defined between an axis of said suction passage (17) in the second end portion of said suction passage (17) and said wall surface (16) is greater than 90° toward an upstream side in the rotational direction of the combing roller (11).

7. The apparatus according to claim 3, wherein the second end portion of the suction passage is rectangular.

8. The apparatus according to claim 1, wherein the rotor (6) is communicated with a first vacuum source (5) and the suction passage (17) is communicated with a second vacuum source (19), and a degree of negative pressure applied to said suction passage (17) by the second vacuum source (19) is adjustable.

9. The apparatus according to claim 8, wherein the angle (θ) is in the range of 150 to 180°.

10. The apparatus according to claim 1, wherein a width of the second end portion of the suction passage is formed to be substantially the same as a width of the combing roller (11).

11. The apparatus according to claim 1, wherein said opening end fine spinning machine is a forced exhaust type, and the vacuum source is communicated with the rotor (6).

12. The apparatus according to claim 1, wherein a flow rate adjusting means (18) is provided midway in said suction passage (17).

13. The apparatus according to claim 1, wherein an angle (θ) defined between an axis of said suction passage (17) in the second end portion of said suction passage (17) and the wall surface (16) is greater than 90° toward an upstream side in the rotational direction of the combing roller (11).

14. The apparatus according to claim 13, wherein the angle (θ) is in the range of 150 to 180°.

15. A fiber transporting apparatus for a rotor type open end fine spinning machine provided with a fiber transporting passage (13) leading from a circumferential surface of a combing roller (11) to a predetermined position within a rotor (6) for introducing fiber opened by an opening device provided with the combing roller (11), and a burling opening portion (12) provided on a downstream side of a fiber feed portion (10) in a rotational direction of the combing roller between the fiber feed portion (10) for feeding sliver (S) to the combing roller and an inlet (13*a*) corresponding to the circumferential surface of the combing roller of the fiber transporting passage (13), wherein:

a second end portion of a suction passage (17), whose first end portion is communicated with a vacuum source, is opened to a wall surface (16) surrounding a periphery of the combing roller (11) between the inlet (13*a*) of the fiber transporting passage (13) and the burling opening portion (12), the second end portion of the suction passage having a plurality of openings (17*a*).

* * * * *